US010468805B2

(12) United States Patent
Evans

(10) Patent No.: US 10,468,805 B2
(45) Date of Patent: Nov. 5, 2019

(54) CONNECTOR POSITION ASSURANCE MEMBER

(71) Applicant: TE CONNECTIVITY CORPORATION, Berwyn, PA (US)

(72) Inventor: Nicholas Lee Evans, Harrisburg, PA (US)

(73) Assignee: TE Connectivity Corporation, Berwyn, PA (US)

( * ) Notice: Subject to any disclaimer, the term of this patent is extended or adjusted under 35 U.S.C. 154(b) by 0 days.

(21) Appl. No.: 15/933,953

(22) Filed: Mar. 23, 2018

(65) Prior Publication Data

US 2019/0296473 A1 Sep. 26, 2019

(51) Int. Cl.

| | |
|---|---|
| ***H01R 13/436*** | (2006.01) |
| ***H01R 13/629*** | (2006.01) |
| ***H01R 13/506*** | (2006.01) |
| ***H01R 13/422*** | (2006.01) |

(52) U.S. Cl.

CPC ... *H01R 13/4368* (2013.01); *H01R 13/62977* (2013.01); *H01R 13/4223* (2013.01); *H01R 13/506* (2013.01); *H01R 13/62927* (2013.01); *H01R 2201/26* (2013.01)

(58) Field of Classification Search

CPC ..... H01R 13/6272; H01R 13/641; H01R 13/6275; H01R 13/4368; H01R 13/62977; H01R 13/506; H01R 13/62927; H01R 13/4223; H01R 2201/26

USPC ..... 439/352, 489

See application file for complete search history.

(56) References Cited

U.S. PATENT DOCUMENTS

| | | | | |
|---|---|---|---|---|
| 5,910,027 | A * | 6/1999 | Wayt | H01R 13/641 439/352 |
| 6,354,860 | B1 * | 3/2002 | Miller | H01R 13/6272 439/352 |
| 9,478,906 | B2 * | 10/2016 | Myer | H01R 13/6273 |
| 9,680,256 | B1 * | 6/2017 | Lane | H01R 13/6275 |
| 9,762,002 | B1 * | 9/2017 | Matsumoto | H01R 13/6271 |
| 2012/0282791 | A1 * | 11/2012 | Brown | H01R 13/639 439/157 |
| 2015/0147901 | A1 * | 5/2015 | Wu | H01R 13/639 439/357 |
| 2015/0295354 | A1 * | 10/2015 | Morello | H01R 13/639 439/352 |
| 2015/0311633 | A1 * | 10/2015 | Miklinski | H01R 13/6273 439/345 |
| 2017/0271815 | A1 * | 9/2017 | Lane | H01R 13/6272 |

* cited by examiner

*Primary Examiner* — Gary F Paumen

(57) ABSTRACT

A connector position assurance device includes a base portion having a latch receiving cavity provided in a top surface and a pair of resiliently deformable beams extending from the base portion, the beams have free ends spaced from the base portion. A first beam of the pair of resiliently deformable beams has a first camming member provided proximate a free end of the first beam. The first beam has a first lockout projection engagement member provided proximate the free end of the first beam and in-line with the first camming member. A second beam of the pair of resiliently deformable beams has a second camming member provided proximate a free end of the second beam. The second beam has a second lockout projection engagement member provided proximate the free end of the second beam and in-line with the second camming member.

14 Claims, 6 Drawing Sheets

CONNECTOR POSITION ASSURANCE MEMBER

FIELD OF THE INVENTION

The present invention is directed to a connector position assurance device, an electrical connector and an electrical connector assembly which provides proper connector position assurance to assure that the mating connectors are properly mated. In particular, the connector position assurance device, the electrical connector and the electrical connector assembly provides proper connector position assurance for a connector assembly of small size.

BACKGROUND OF THE INVENTION

In certain applications, electronic components require an electrical connector assembly that joins first and second housings containing electrical contacts. One housing includes male electrical contacts, while the other housing includes female electrical contacts. The first housing is configured to be received inside the second housing such that the male and female electrical contacts are electrically connected. In order to be sure that the first and second housings are properly connected with the electrical contacts, the first and second housing are provided with a latch assembly more generally referred to as a position assurance feature. In known applications, the latch assembly includes a base plate, a suspended prong on the first housing and a ramp on the second housing. The base plate is slidably retained beside the prong. When the first housing is inserted about the second housing, the prong snaps over the ramp and the base plate is then slid over the ramp and the prong into an engagement position. In many applications an audible click is typically used to detect if the connector is fully mated, however, noise at the assembly plant can make this ineffective.

Additionally, electrical connectors have been proposed that utilize a latch or retention assembly to maintain connector halves in a fully mated position, along with a connector position assurance (CPA) device. When the connector halves are mated and the latch or retention assembly is positioned to maintain contact between the connector halves, the connector position assurance device is moved to a position that indicates the connector halves are properly connected. Thus, the connector position assurance device provides a means to assure that the connector halves are fully mated.

Known connector position assurance devices require a significant space as compared to the first and second housings. Consequently, known connector position assurance devices are not practical with small connectors, as the connector size limits how the connector position assurance can interact with the housings. In addition, even when using known connector position assurances, a significant amount of connectors fail to mate properly. For example, the largest warranty problem with automotive connectors is that the connectors are not fully mated, causing system failures after the automobile has left the assembly plant. This is due to the fact that at the vehicle assembly plant, some connectors are mated far enough to make initial, electrical contact but the latches of the connectors are not fully engaged, causing the connectors to not be locked or secured together. These connectors later come apart in the field, as the vehicle is driven on bumpy roads etc. causing loss of system function. Even incorporating known connector position assurances into the connectors does not guarantee that the connectors will be properly mated and secured, as in many instances the operator does not properly activate the connector position assurances.

It would be beneficial to have a connector position assurance device which overcomes the problems identified above and which provides proper connector position assurance for a connector assembly of small size. It would also be beneficial to prevent or block the connector position assurance from its fully engaged position if the connector is partially mated or not mated at all.

SUMMARY OF THE INVENTION

An embodiment is directed to a connector position assurance device having a base and a pair of resiliently deformable beams. The base portion has a top surface, a bottom surface, a base front end and a base back end. The pair of resiliently deformable beams extends from the front end of the base portion in a direction away from the back end of the base portion. The beams have free ends spaced from the base portion. A first beam of the pair of resiliently deformable beams has a first camming member provided proximate a free end of the first beam. The first beam has a first lockout projection engagement member provided proximate the free end of the first beam and in-line with the first camming member. A second beam of the pair of resiliently deformable beams has a second camming member provided proximate a free end of the second beam. The second beam has a second lockout projection engagement member provided proximate the free end of the second beam and in-line with the second camming member. A latch receiving cavity is provided in the top surface of the base portion. The connector position assurance device is maintained in an initial position on a connector until the first camming member and the second camming member engage a mating connector to allow the first lockout projection engagement member and the second lockout projection engagement member to move past lockout projections of the connector.

An embodiment is directed to a connector having a connector position assurance device. The connector includes a latch extending from a housing of the connector and a connector position assurance receiving recess positioned proximate the latch. A lockout projection is provided in the housing, the lockout projection extending into the connector position assurance receiving recess. A connector position assurance device is positioned in the connector position assurance receiving opening. The connector position assurance device includes a base portion having a latch receiving cavity provided in a top surface and a pair of resiliently deformable beams extending from the base portion, the beams have free ends spaced from the base portion. A first beam of the pair of resiliently deformable beams has a first camming member provided proximate a free end of the first beam. The first beam has a first lockout projection engagement member provided proximate the free end of the first beam and in-line with the first camming member. A second beam of the pair of resiliently deformable beams has a second camming member provided proximate a free end of the second beam. The second beam has a second lockout projection engagement member provided proximate the free end of the second beam and in-line with the second camming member. The connector position assurance device is maintained in an initial position on the connector until the first camming member and the second camming member engage a mating connector to allow the first lockout projection engagement member and the second lockout projection engagement member to move past the lockout projection of the connector.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
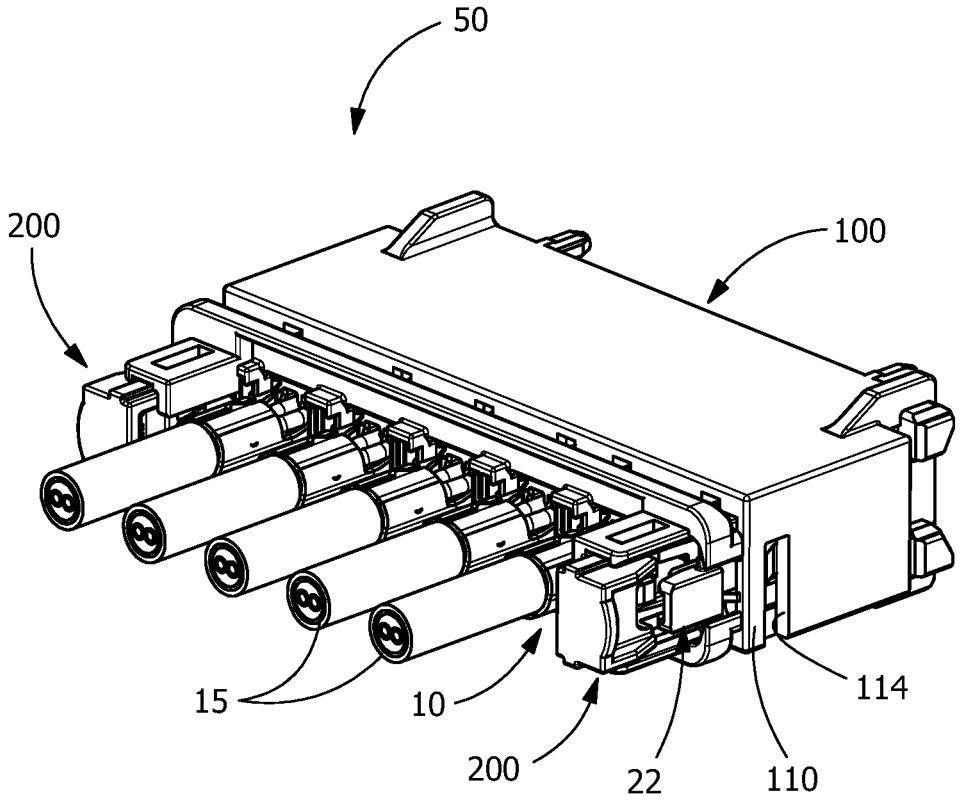
FIG. 1 is a perspective view of an illustrative plug connector mated with an illustrative header or mating connector.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

FIG. 1 shows a perspective view of an electrical connector or plug 10 mated with a mating connector or header 100 which together form a connector assembly 50. The electrical connector 10 and mating connector 100 are shown as representations and may vary without departing from the scope of the invention. The connectors 10 and 100 will have many other features, such as contacts and contact latches, which are not shown in the figures.

Figure 2:
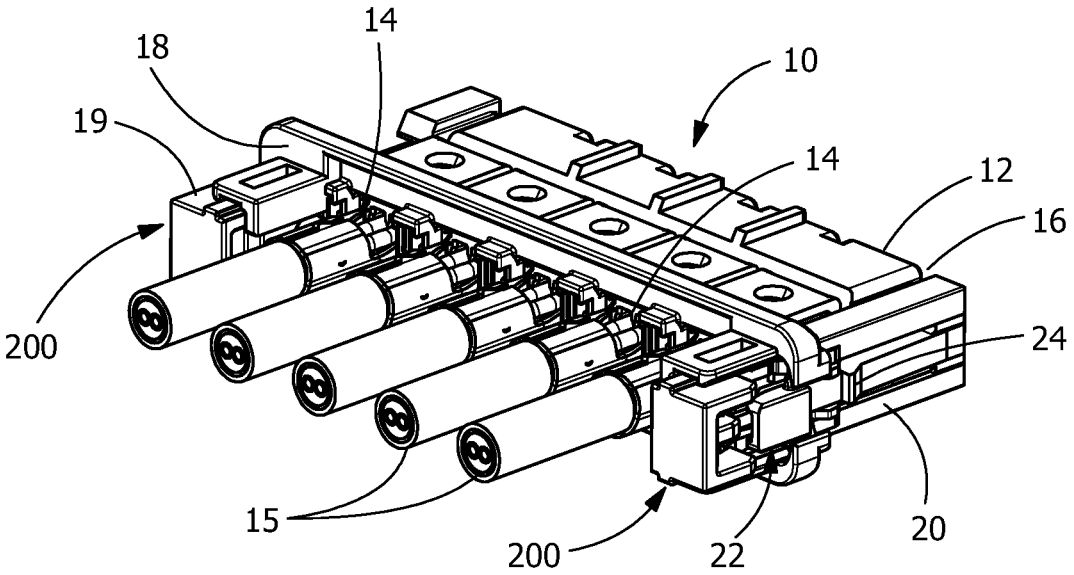
FIG. 2 is a top perspective view of the plug connector of FIG. 1.
Figure 6A:
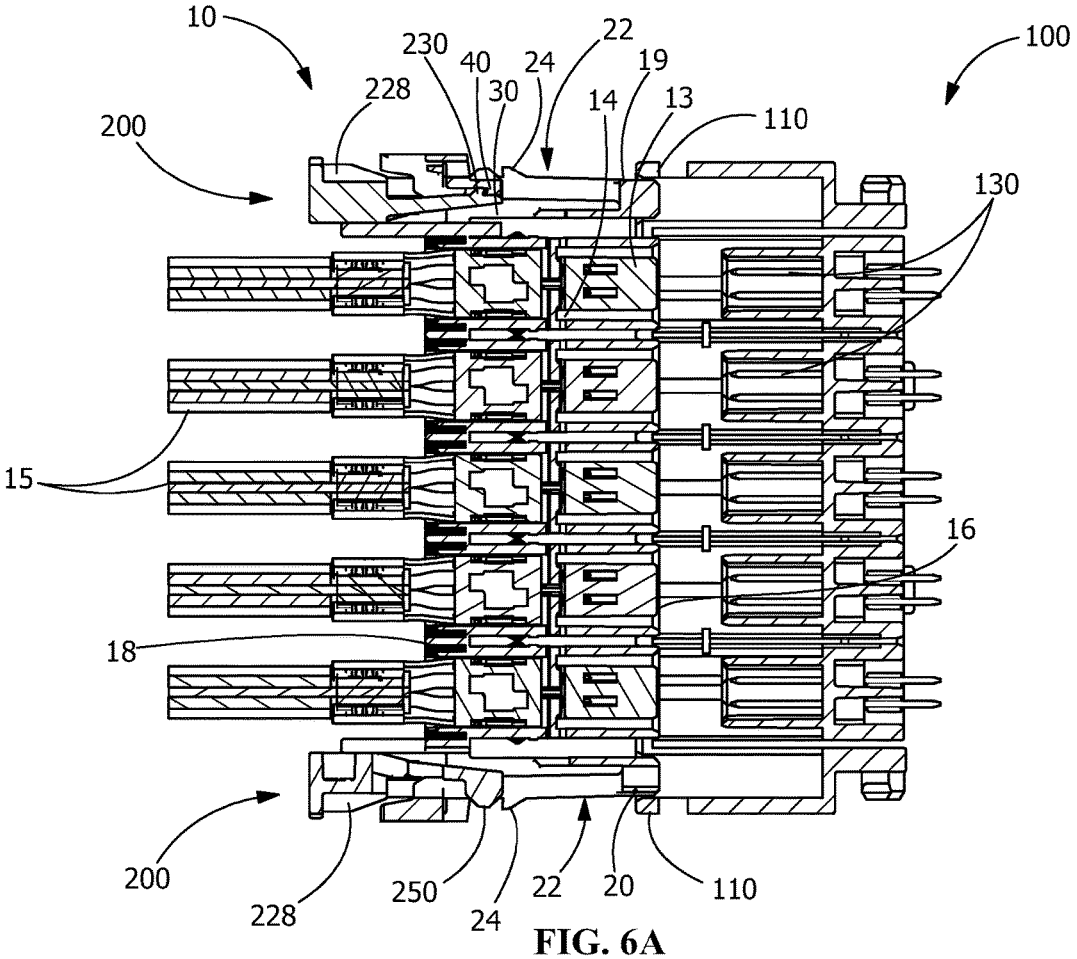
FIG. 6A is a cross-sectional view taken through a beam of the connector position assurance member showing the plug connector initially engaging the header or mating connector with the connector position assurance member in an initial position.
Figure 6B:
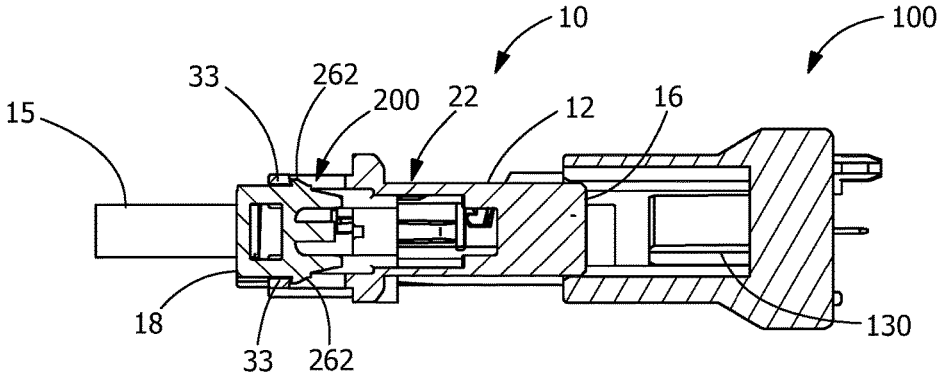
FIG. 6B is a cross-sectional view taken through positioning arms of the plug connector showing the connector position assurance member in the initial position.

Referring to FIG. 2, the electrical connector 10 has a housing body 12 with contact receiving passages 14 for receiving contacts 13 therein (FIG. 6A). The electrical connector 10 has a forward mating end 16 and a rearward end 18. Conductors or wires 15, which are in electrical engagement with the contacts 13 inserted in the passages 14, extend from the rearward end 18. A first side surface 19 and an oppositely facing second side surface 20 extend between the mating end 16 and the rearward end 18.

Latches or latch arms 22 having engagement projections 24 extend from the side surfaces 19, 20. In the embodiment shown, each latch 22 is connected to a respective side surface 19, 20 proximate the forward mating end 16 and extends toward the rearward end 18. The latches 22 are used to latch and secure the mating connector 100 to the connector 10, as will be more fully described below. As shown in FIGS. 6 through 9, positioned proximate the latch arm 22 is a connector position assurance (CPA) receiving recess 30. Lockout projections 40 are provided proximate to the latch 22 and extend into a connector position assurance receiving recess 30 to cooperate with the connector position assurance device 200. The lockout projections 40 are provided on either side of the latch 22.

Figure 3:
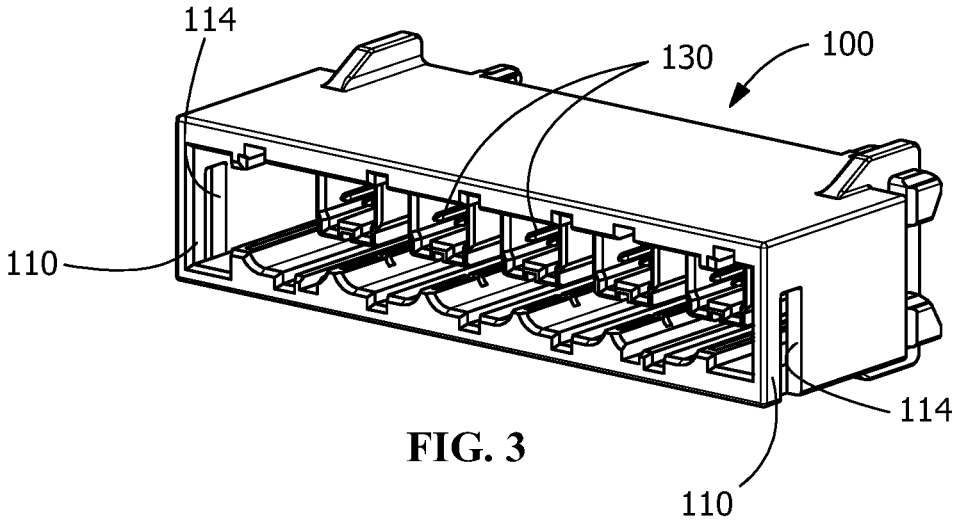
FIG. 3 is a front perspective view of the header or mating connector of FIG. 1.

As best shown in FIG. 3, the mating connector 100 has a complimentary latch engagement section 110 which is positioned to engage the latch arm 22 as the connector 10 and the mating connector are moved from an unmated position to a mated position. A latch-receiving opening 114 is positioned proximate the latch engagement or activation section 110 and is dimensioned to receive the engagement projection 24 when the connector 10 is fully mated to the mating connector 100. The latch engagement or activation sections 110 also acts as connector position assurance engagement ribs.

When properly mated together, the engagement projection 24 of the latch arm 22 cooperates with and is positioned in the latch-receiving opening 114 to secure the mating connector 100 with the electrical connector 10. In the mated position, the connector 10 is received within the shroud 120 of the mating connector 100. Electrical contacts 130 (FIGS. 6A and 6B) of the mating connector 100 mate with electrical contacts 13 in the electrical connector 10.

As shown in FIGS. 6 through 9, a connector position assurance device 200 is positioned proximate to and is movable relative to the latch arm 22 of the connector 10. The connector position assurance device 200 is maintained in the connector position assurance receiving opening 30 and is movable between a first position or open position, as shown in FIG. 6, and a second or fully inserted position, as shown in FIG. 9.

Figure 4:
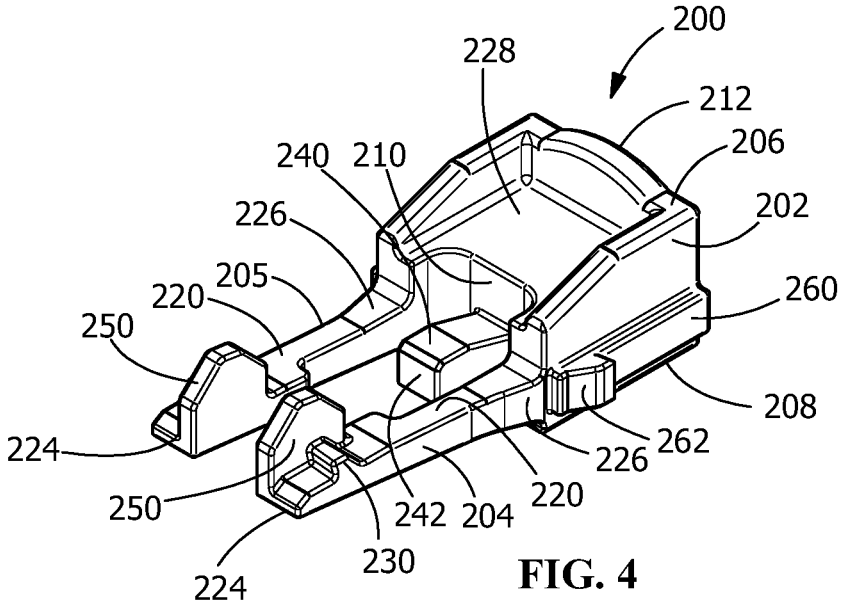
FIG. 4 is a top perspective view of an illustrative connector position assurance member housed in the plug connector.
Figure 5:
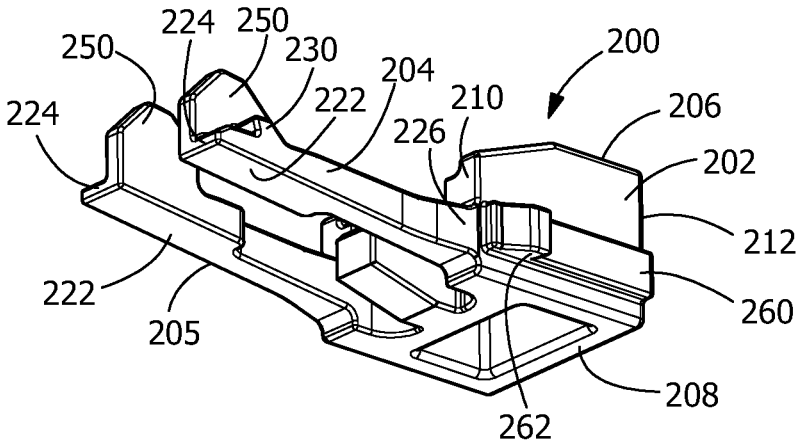
FIG. 5 is a bottom perspective view of the connector position assurance member of FIG. 4.

Referring to FIGS. 4 and 5, the connector position assurance device 200 has a base portion 202 and two resiliently deformable beams 204, 205 which extend from the base portion 202. The beam 204 has a longitudinal axis which is essentially parallel to a longitudinal axis of the beam 205. The base portion 202 has a top surface 206, a bottom surface 208, a base front end 210 and a base back end 212. The beams 204 extend from the front end 210 in a direction away from the back end 212. The back end 212 is configured to allow an operator to manually engage or activate the connector position assurance device 200. The front end 210 of the base portion 212 has a latch engagement portion which extends from the top surface 206 and is configured to interact with the latch 22, when the connector 10 is not fully mated with the mating connector 100, as will be more fully described. A latch receiving cavity 228 is provided in top surface.

Each of the resiliently deformable beams 204, 205 has a top side 220, a bottom side 222, a beam front end 224, a beam back end 226 an inner side wall 225 and an outer side wall 227. The inner side wall 225 of beam 204 faces the inner side wall 225 of beam 205. The back end 226 of each beam 204, 205 is attached to or is integral with the front end 210 of the base portion 202.

A lockout projection engagement member 230 extends from the top side 220 of each of the beams 204, 205. Provided proximate to and in-line with the lockout projection engagement members 230 are camming members 250. The camming members 250 extend from the top side 220 of each beam 204, 205. The camming members 250 are provided proximate free ends of the beams 204, 205 and proximate the inner side walls 225 of the beams 204, 205. The lockout projection engagement members 230 are provided proximate the free ends of the first beam and the first camming member and proximate the outer side wall of the beams 204, 205. The camming members 250 have sloped surfaces 252 to better cooperate with the activation section 110 of the mating connector 100, as will be more fully described.

Positioning rails 260 extend from the base portion 202. The positioning rails 260 have latching projections 262. The positioning rails 260 cooperate with mating recesses in the connector 10 to provide the proper positioning and stabilization to the connector position assurance device 200 relative to housing body 12 of the connector 10. The latching projections 262 cooperate with the connector 10 to prevent the removal of the connector position assurance device 200 from the connector 10 and to retain the connector position assurance device 200 in the first position on the connector 10 prior to mating with the mating connector 100. The longitudinal axis of the positioning rails 260 is essentially parallel to the longitudinal axis of the beams 204, 205.

Referring to FIGS. 6 through 10, the progression or method of inserting the plug or connector 10 into the header or mating connector 100 is shown. In FIGS. 6A and 6B, the connector 10 is shown loosely positioned in the header connector 100. In this position, the engagement projection 24 of the latch 22 has not engaged the latch engagement section 110 of the connector 100. The connector position assurance device 200 is maintained in the pre-mated, open or first position. In this position, the latch 22 is in a normal or undeflected position. As best shown in FIG. 6B, the connector position assurance device 100 is maintained in the pre-mated, open or first position by the cooperation of the latching projections 262 with projections 33 which extend into connector position assurance latch arm receiving opening 32. In addition, as best shown in FIG. 6A, lockout projections 40 of the connector 10 engages the lockout projection engagement members 230 to prevent the unwanted insertion of the connector position assurance device 200 to a mated, second or inserted position.

Figure 7:
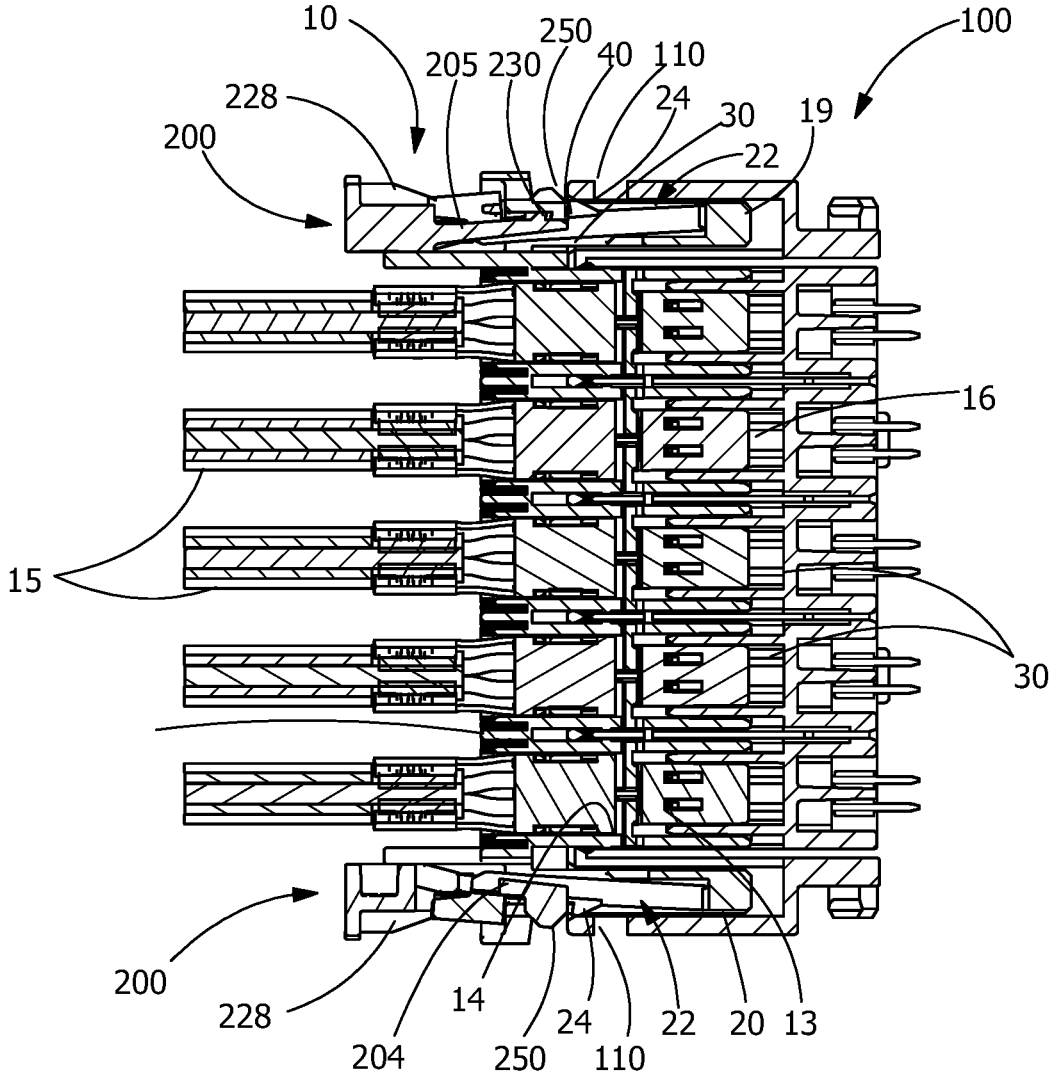
FIG. 7 is a cross-sectional view taken through the beam of the connector position assurance member showing the plug connector partially mated to the header or mating connector with the connector position assurance member in the initial position.

As the connector 10 is partially inserted into the shroud 120 of the mating connector 100, the engagement projection 24 of the latch 22 is moved into engagement with the latch engagement section 110 of the mating connector 100. As insertion continues, the latch engagement section 110 causes the engagement projection 24 and the latch 22 to be resiliently activated or deflected away from either side surface 19, 20 of the connector 10, as shown in FIG. 7. If the connector 10 cannot properly mate with the mating connector 100, for example due to improper alignment of the contacts 13, 130, the continued insertion of the connector 10 into the mating connector 100 may be prevented. If this occurs, the latch 22 will remain in the deflected position shown in FIG. 7. In this position, the connector position assurance device 200 cannot be moved to a second or inserted position, as the latch 22 will engage the front end 242 of the latch cooperation member 240 of the connector position assurance device 200 to prevent the movement of the connector position assurance device 200 to the mated, second or inserted position.

Figure 8:
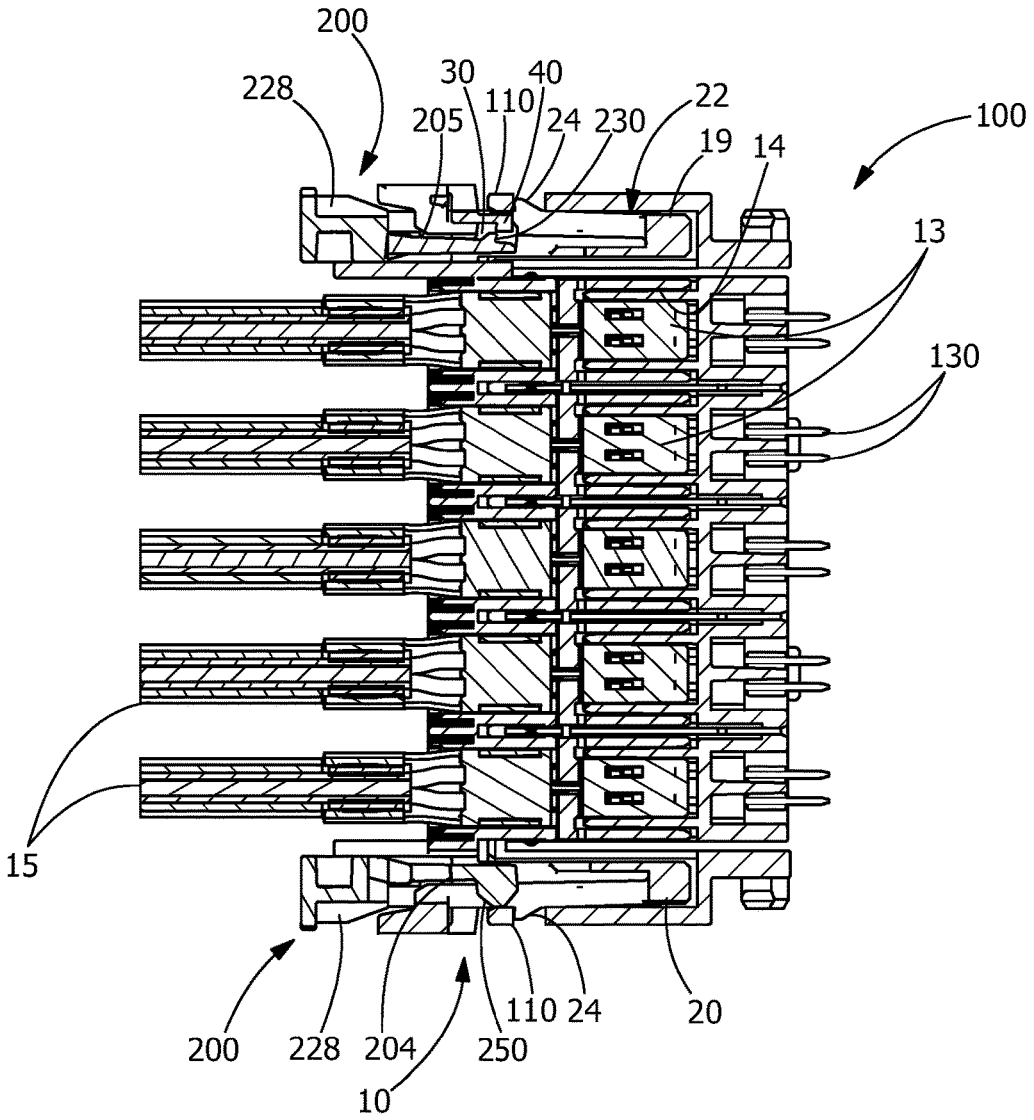
FIG. 8 is a cross-sectional view taken through the beam of the connector position assurance member showing the plug connector fully mated to the header or mating connector with the connector position assurance member between the initial position and a final or locked position.

As insertion continues, as shown in FIG. 8, the engagement portion 24 of the latch 22 is moved past the latch engagement section 110, allowing the latch 22 to return to its original or unstressed position. In this position, the engagement portion 24 is positioned and retained in the latch receiving opening 114. With the engagement portion 24 properly positioned in the latch receiving opening 114, the connector position assurance device 200 can be moved from the pre-mated, open or first position toward the mated, second or inserted position. As this occurs, the camming members 250 engage the connector position assurance activation areas 140 of the mating connector 100, forcing the camming members 250 and the resiliently deformable beams 204, 205 to move toward the bottom surface 20 of the connector 10. As this occurs, the lockout projection engagement member 230 is moved below the lockout projection 40 of the connector 10, thereby allowing the continued insertion of the connector position assurance device 200 into the connector position assurance receiving recess 30 of the connector 10 to continue. However, if the connector 10 and mating connector 100 are not fully mated, the camming members 250 will not engage the connector position assurance activation areas 140, thereby preventing the movement of the resiliently deformable beams 204, 205 and the lockout projection engagement member 230. Consequently, continued insertion of the connector position assurance device 200 will be prevented by the cooperation of the lockout projection engagement member 230 with the lockout projection 40.

Figure 9A:
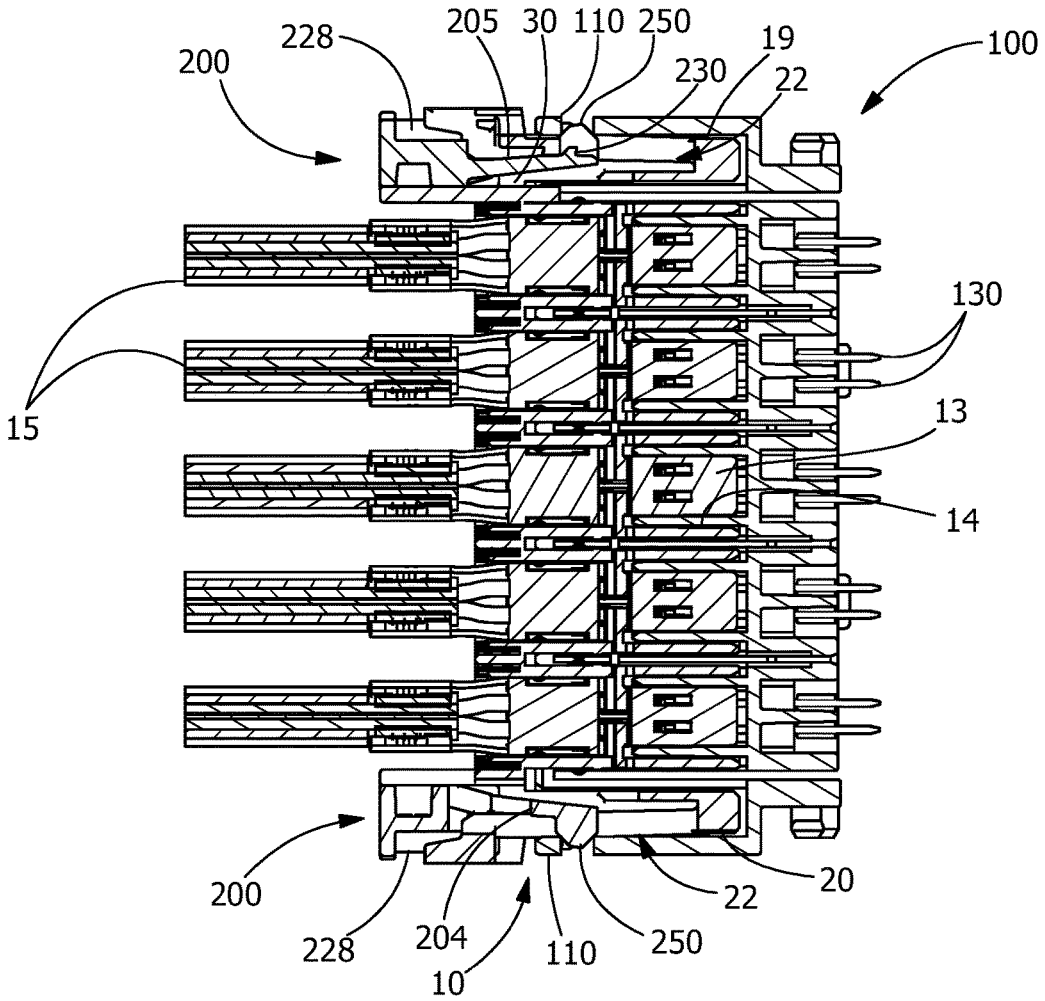
FIG. 9A is a cross-sectional view taken through the beam of the connector position assurance member showing the plug connector fully mated to the header or mating connector with the connector position assurance member in the final or locked position.
Figure 9B:
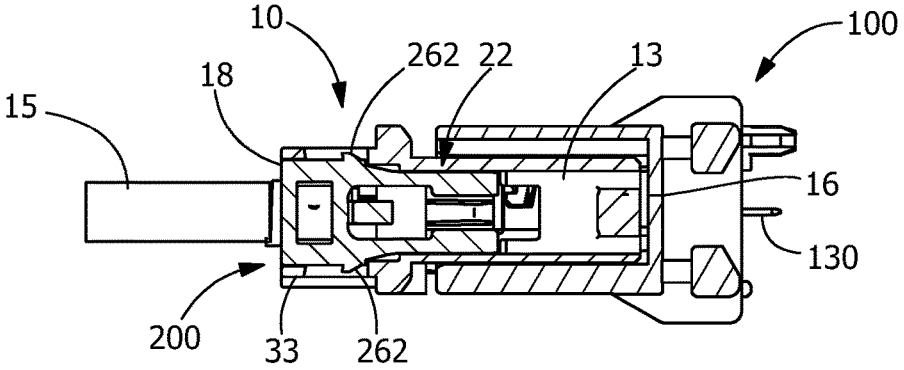
FIG. 9B is a cross-sectional view taken through positioning arms of the plug connector showing the plug connector fully mated to the header or mating connector with the connector position assurance member in the final or locked position.

With the resiliently deformable beams 204, 205 properly deflected, the insertion of the connector position assurance device 200 can continue. As insertion continues, as shown in FIGS. 9A and 9B, the connector position assurance device 200 is moved to the mated, second or inserted position. In this position, the camming members 250 is moved beyond the connector position assurance activation areas 140 of the mating connector 100 into the latch-receiving opening 114, allowing the camming members 250 and the resiliently deformable beams 204, 205 to return toward an unstressed position. In this position, the lockout projection engagement member 230 is moved past the lockout projection 40 of the connector to the mated, closed or second position.

The connector position assurance device 200 is maintained in the mated, closed or second position by the cooperation of the camming members 250 with the latch-receiving opening 114.

In this fully inserted position, the latch-receiving cavity 228 of the connector position assurance device 200 is positioned beneath latch 22. In the fully inserted position, the latch cooperation member 240 of the connector position assurance device 200 is positioned below the latch 22 to block the activation or movement of the latch 22, preventing the unwanted or inadvertent unmating of the connector 10 from the mating connector 100.

If the connector 10 is to be unmated from the mating connector 100, the connector position assurance device 200 is returned to the initial position. A force applied to the connector position assurance device 200 in the opposite direction of insertion, forces the camming members 250 to move out of latch-receiving opening 114, allowing the movement of the connector position assurance device 200 toward the pre-mated, open or first position. As the movement continues, the top surface 206 of the connector position assurance device 200 is moved away from the latch 22, allowing the latch 22 to be depressed, which in turn allows the connector 10 to be unmated from the mating connector 100.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials and components, without departing from the spirit or essential characteristics thereof. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A connector position assurance device comprising:

a base portion having a top surface, a bottom surface, a base front end and a base back end;

a pair of resiliently deformable beams extending from the front end of the base portion in a direction away from the back end of the base portion, the beams having free ends spaced from the base portion;

a first beam of the pair of resiliently deformable beams having a first camming member provided proximate a free end of the first beam, the first beam having a first lockout projection engagement member provided proximate the free end of the first beam and in-line with the first camming member;

a second beam of the pair of resiliently deformable beams having a second camming member provided proximate a free end of the second beam, the second beam having a second lockout projection engagement member provided proximate the free end of the second beam and in-line with the second camming member;

a latch receiving cavity provided in the top surface of the base portion;

positioning rails extending from the base portion, longitudinal axes of the positioning rails being parallel to longitudinal axes of the first beam and the second beam, the positioning rails are configured to cooperate with a connector to provide proper positioning and stabilization of the connector position assurance device relative to the connector;

latching projections positioned on the positioning rails, the latching projections configured to cooperate with the connector to prevent the removal of the connector position assurance device from the connector beyond an initial position;

wherein the connector position assurance device is maintained in the initial position on a connector until the first camming member and the second camming member engage a mating connector to allow the first lockout projection engagement member and the second lockout projection engagement member to move past lockout projections of the connector.

2. The connector position assurance device as recited in claim 1, wherein a latch engagement portion is provided on the front end of the base portion and extends from the top surface of the base portion.

3. The connector position assurance device as recited in claim 1, wherein the first beam of the pair of resiliently deformable beams has an inner side wall which faces the second beam of the pair of resiliently deformable beams and an outer side wall which faces in a direction away from the second beam of the pair of resiliently deformable beams, the first camming member is provided proximate the inner side wall of the first beam.

4. The connector position assurance device as recited in claim 3, wherein the first lockout projection engagement member is provided proximate the outer side wall of the first beam.

5. The connector position assurance device as recited in claim 4, wherein the second beam of the pair of resiliently deformable beams has an inner side wall which faces the first beam of the pair of resiliently deformable beams and an outer side wall which faces in a direction away from the first beam of the pair of resiliently deformable beams, the second camming member is provided proximate the inner side wall of the second beam.

6. The connector position assurance device as recited in claim 5, wherein the second lockout projection engagement member is provided proximate the outer side wall of the second beam.

7. The connector position assurance device as recited in claim 1, wherein a longitudinal axis of the first beam is parallel to a longitudinal axis of the second beam.

8. The connector position assurance device as recited in claim 1, wherein the first camming member and the second camming member have sloped surfaces.

9. A connector having a connector position assurance device, the connector comprising:

a latch extending from a housing of the connector;

a connector position assurance receiving recess positioned proximate the latch;

a lockout projection provided in the housing, the lockout projection extending into the connector position assurance receiving recess;

a connector position assurance device positioned in the connector position assurance receiving opening, the connector position assurance device comprising:

a base portion having a latch receiving cavity provided in a top surface;

a pair of resiliently deformable beams extending from the base portion, the beams having free ends spaced from the base portion;

a first beam of the pair of resiliently deformable beams having a first camming member provided proximate a free end of the first beam, the first beam having a first lockout projection engagement member provided proximate the free end of the first beam and in-line with the first camming member;

a second beam of the pair of resiliently deformable beams having a second camming member provided proximate a free end of the second beam, the second beam having a second lockout projection engagement member provided proximate the free end of the second beam and in-line with the second camming member;

positioning rails extending from the base portion, longitudinal axes of the positioning rails being parallel to longitudinal axes of the first beam and the second beam, the positioning rails are configured to cooperate with the housing of the connector to provide proper positioning and stabilization of the connector position assurance device relative to the connector;

latching projections positioned on the positioning rails, the latching projections configured to cooperate with the connector to prevent the removal of the connector position assurance device from the connector beyond an initial position;

wherein the connector position assurance device is maintained in the initial position on the connector until the first camming member and the second camming member engage a mating connector to allow the first lockout projection engagement member and the second lockout projection engagement member to move past the lockout projection of the connector.

10. The connector as recited in claim 9, wherein the lockout projections extend into the connector position assurance receiving recess on either side of the latch.

11. The connector as recited in claim 10, wherein the first beam of the pair of resiliently deformable beams has an inner side wall which faces the second beam of the pair of resiliently deformable beams and an outer side wall which faces in a direction away from the second beam of the pair of resiliently deformable beams, the first camming member is provided proximate the inner side wall of the first beam, the first lockout projection engagement member is provided proximate the outer side wall of the first beam.

12. The connector as recited in claim 11, wherein the second beam of the pair of resiliently deformable beams has an inner side wall which faces the first beam of the pair of resiliently deformable beams and an outer side wall which faces in a direction away from the first beam of the pair of resiliently deformable beams, the second camming member is provided proximate the inner side wall of the second beam, the second lockout projection engagement member is provided proximate the outer side wall of the second beam.

13. The connector as recited in claim 12, wherein a longitudinal axis of the first beam is parallel to a longitudinal axis of the second beam.

14. The connector as recited in claim 13, wherein the first camming member and the second camming member have sloped surfaces.

* * * * *